US005094443A

United States Patent [19]

Young, Jr.

[11] Patent Number: 5,094,443

[45] Date of Patent: Mar. 10, 1992

[54] SHEET CONVEYING APPARATUS

[75] Inventor: John J. Young, Jr., Beacon Falls, Conn.

[73] Assignee: Pitney Bowes Inc., Stamford, Conn.

[21] Appl. No.: 636,455

[22] Filed: Dec. 28, 1990

[51] Int. Cl.[5] ..... B65H 9/04

[52] U.S. Cl. ..... 271/245; 271/256; 271/273; 271/275; 271/189; 271/198; 198/626.2; 198/626.3

[58] Field of Search ..... 271/245, 246, 256, 266, 271/273, 274, 275, 182, 189, 198; 198/836.2, 626.2, 626.5

[56] References Cited

U.S. PATENT DOCUMENTS

| | | | |
|---|---|---|---|
| 3,683,758 | 8/1972 | Feldkamper | 93/93 DP |
| 3,877,696 | 4/1975 | Miciukiewicz | 271/227 |
| 4,078,790 | 3/1978 | Stockerr | 271/213 |
| 4,844,445 | 7/1989 | Murata et al. | 271/275 |
| 4,850,584 | 7/1986 | Watashi | 271/274 |

FOREIGN PATENT DOCUMENTS

| | | | |
|---|---|---|---|
| 2312655 | 9/1973 | Fed. Rep. of Germany | 198/626.5 |
| 476996 | 3/1968 | Japan | 271/246 |
| 513716 | 10/1939 | United Kingdom | 271/246 |

OTHER PUBLICATIONS

Froula et al., Document Feed, 7-72, IBM Technical Disclosure, vol. 15, No. 2, p. 45.

*Primary Examiner*—H. Grant Skaggs
*Assistant Examiner*—Carol Lynn Druzbick
*Attorney, Agent, or Firm*—Charles R. Malandra, Jr.; David E. Pitchenik; Melvin J. Scolnick

[57] ABSTRACT

Apparatus for conveying one or more sheets of paper. The apparatus includes a supporting housing; a first, upstream pulley and a second, downstream pulley rotatably mounted on the housing; a lower, endless, elastic belt mounted on the first and second pulleys, the belt having an upper and a lower reach, the reaches being substantially horizontal; a third, downstream pulley rotatably mounted on the housing above the lower belt; a fourth, upstream pulley rotatably mounted on the housing above the lower belt, the fourth pulley biased toward the lower belt; and an upper, endless, elastic belt mounted on the third and fourth pulleys, whereby the fourth pulley can move away from the lower belt when the thickness of the sheets being conveyed requires a larger gap to engage the upper belt.

5 Claims, 2 Drawing Sheets

SHEET CONVEYING APPARATUS

BACKGROUND OF THE INVENTION

The instant invention relates to apparatus for conveying sheets of paper, and more particularly to such apparatus which is capable of conveying collations of paper of varying thickness.

Conveying apparatus for transporting sheets is used in a variety of machinery, one such example being an inserting machine which inserts paper documents into an envelope. The sheet handling apparatus upstream of the inserter typically has conveyors which advance the sheets one at a time or in sets along a feed path which will ultimately deliver those sheets to an inserting station in the inserter. The sheets may be accumulated and stapled and then sent forward to the inserting station. Sometimes the accumulated sheets are stapled and then folded before being inserted into an envelope.

Many of the sheet conveyors employ continuously moving, O-ring style belt members, and problems are incurred when the sheets initially engage the O-ring belts. In this style conveyor, the lower reach of an upper belt lies very close to the upper reach of a lower belt in order to exert pressure on the documents to be conveyed. However, when large sets of sheets (i.e. up to 50 sheets of 20 lb. paper) are fed through the conveyor, a large amount of pressure builds between the belts being deflected by the sets that the sets jam. The conveyor must feed these sets of sheets, whether 0.008 inches thick or up to 0.225 inches thick, at equal rates, with no jamming occurring, in order to insure that the inserter throughput is maintained.

The instant invention thus provides a continuously running, O-ring belt type sheet conveyor which is capable of feeding a single sheet or a set (collation) of sheets at equal rates without any jamming occurring.

SUMMARY OF THE INVENTION

Accordingly, the instant invention provides apparatus for conveying one or more sheets of paper. The apparatus comprises a supporting housing; a first, upstream pulley and a second, downstream pulley rotatably mounted on the housing; a lower, endless, elastic belt mounted on the first and second pulleys, the belt having an upper and a lower reach, the reaches being substantially horizontal; a third, downstream pulley rotatably mounted on the housing above the lower belt; a fourth, upstream pulley rotatably mounted on the housing above the lower belt, the fourth pulley biased toward the lower belt; and an upper, endless, elastic belt mounted on the third and fourth pulleys, whereby the fourth pulley can move away from the lower belt when the thickness of the sheets being conveyed requires a larger gap to engage the upper belt.

DETAILED DESCRIPTION OF THE PREFERRED EMBODIMENT

Figure 1:
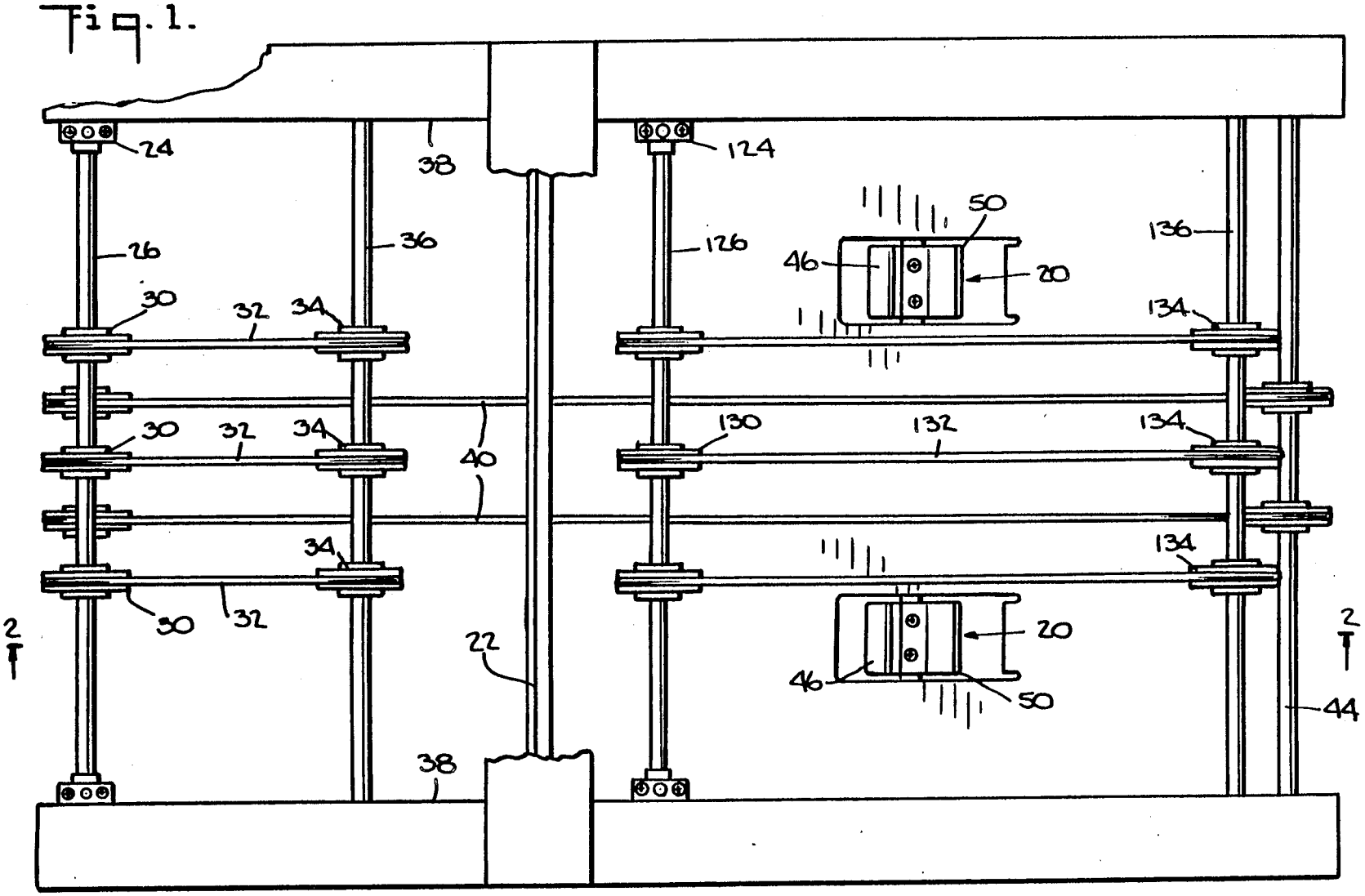
FIG. 1 is a top, plan view of conveying apparatus in accordance with the instant invention.
Figure 2:
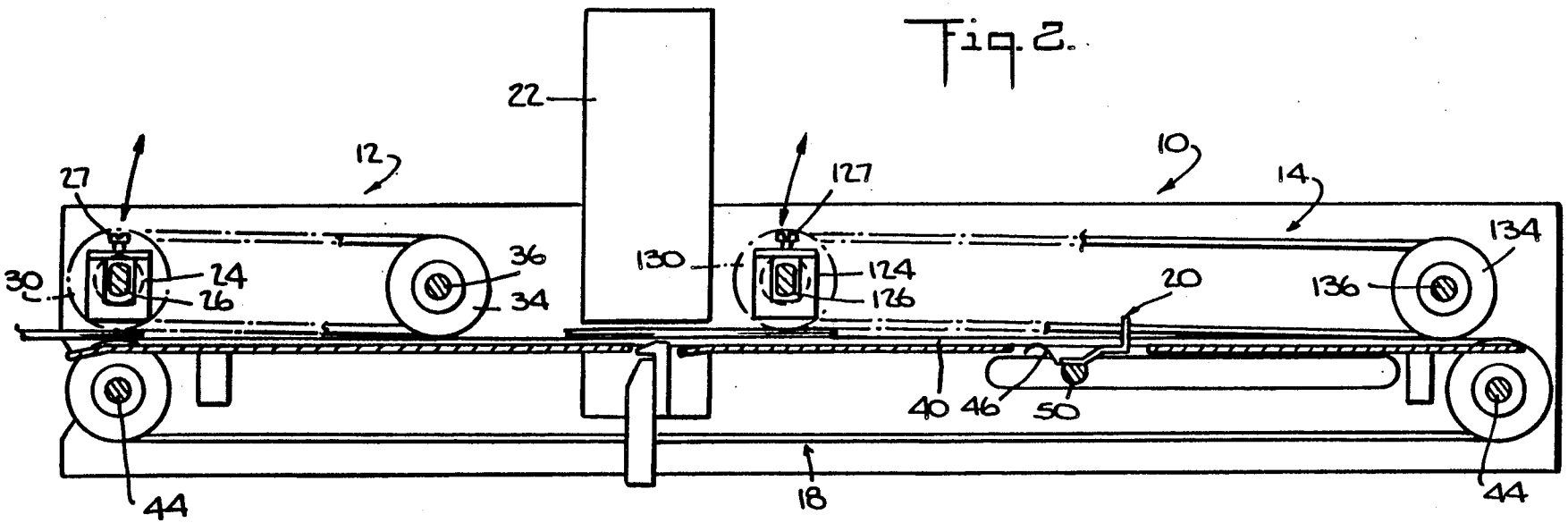
FIG. 2 is a sectional view taken on the vertical plane indicated by the line 2—2 in FIG. 1.

In describing the preferred embodiment of the instant invention, reference is made to the drawings, wherein there is seen in FIGS. 1 and 2 sheet conveying apparatus generally designated 10, consisting of a first section of O-ring units 12 and a second section of O-ring units 14 which serially act upon the sheets 16 being conveyed. The O-rings units 12 and 14 are situated above a lower section of O-ring units 18. Initially, a set of sheets 16 is conveyed through the first section 12 toward the second section 14 where the sheets 16 stop at a pair of registration devices 20. A stapler 22 is located intermediate both sections 12 and 14. When the sheets 16 are stopped by the registration devices 20, the stapler 22 places a staple through the trailing end of the sets of sheets 16 as predetermined in the operation of the conveying apparatus 10.

The first section of O-ring units 12 includes a pair of slotted bearing holders 24. A shaft 26 is mounted in a pair of ball bearings 28 which seat in the bearing holders 24. Three pulleys 30 are mounted on the shaft 26 and support three, continuously running O-ring belts 32. Three pulleys 34 mounted on a fixed shaft 36 support the other end of the belts 32. The shaft 26 does not extend to the side walls 38 of the conveyor 10, so that the shaft 26 may move or pivot upwards when a thick set of sheets 16 enters the conveyor section 12. The pivot action occurs about the center of the shaft 36. The bearing holders 24 are weighted so that a gravity force is always bearing upon the sheets 16 being conveyed. The bearing holders 24 include a screw 27 which can raise or lower the shaft 26 accommodate thicker or thinner collations as required; i.e. if the screws 27 are set higher, the shaft 26 has more room to move upward and away from the collation of sheets 16. The gravity force is constant, unlike prior art situations in which excessive force built up with the thicker sets of sheets 16 moving through, which resulted in unwanted sheet jams.

The second section of O-ring units 14 is similar to the first section of O-ring units 12, and includes a pair of slotted bearing holders 124. A shaft 126 is mounted on a pair of ball bearings 128 which seat in the bearing holders 124. Three pulleys 130 are mounted on the shaft 126 and support three, continuously running O-ring belts 132. Three pulleys 134 mounted on a fixed shaft 136 support the other end of the belts 132. The shaft 126 does not extend to the side walls 38 of the conveyor 10, so that the shaft 126 may move or pivot upwards when a thick set of sheets 16 enters the conveyor section 14. The pivot action occurs about the center of the shaft 136. The bearing holders 124 are weighted so that a gravity force is always bearing upon the sheets 16 being conveyed, and the force is constant. The bearing holders 124 include a screw 127 which can raise or lower the shaft 126 to accommodate thicker or thinner collations as required; i.e. if the screws 127 are set higher, the shaft 126 has more room to move upward and away from the collation of sheets 16.

The lower section of O-ring units 18 consists of a pair of continuously running O-ring belts 40 which ride on four pulleys 42 rotatably mounted on a pair of shafts 44 mounted in the side walls 38 of the conveyor 10.

Figure 4:
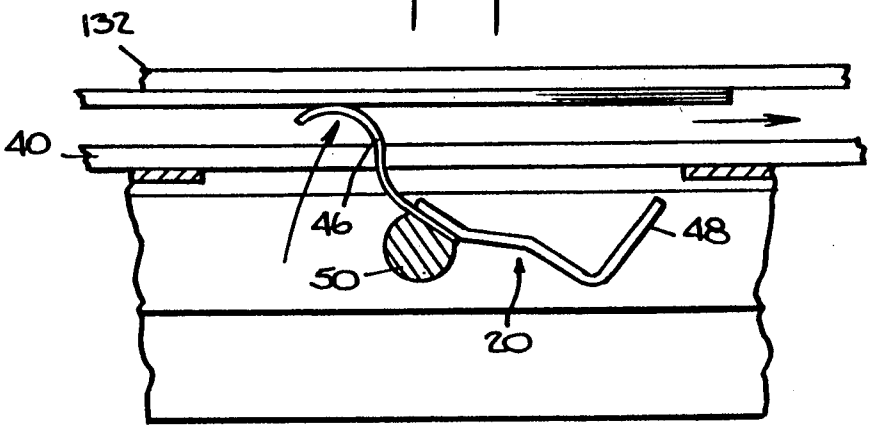
FIG. 4 is similar to FIG. 3 but shows the registration device in the conveying position.
Figure 3:
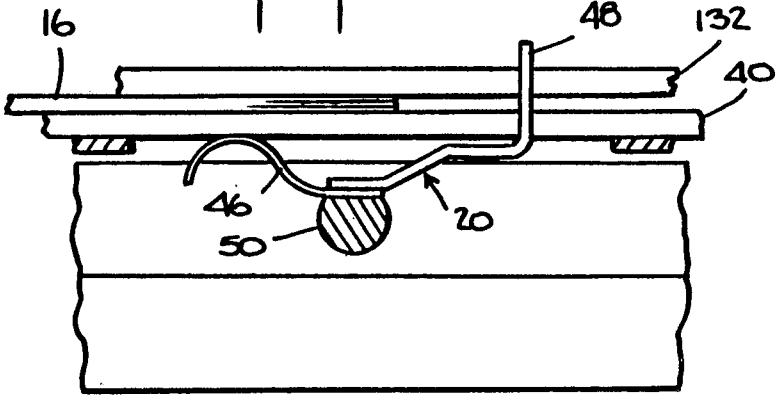
FIG. 3 is an enlarged, side, elevational view of the registration device seen in FIGS. 1 and 2, showing the registration device is the stop position.

The registration devices are such that they permit a subtle spring force to be applied to the bottom side of the set of sheets 16 when the registration devices 20 are moved away. Each registration device 20 (see FIGS. 3 and 4) includes a spring 46 and a stopping member 48 mounted on a shaft 50. In FIG. 3, the registration device 20 is shown in the stop position, whereby a collation of sheets 16, having been conveyed by the continuously moving belts 32 and 40, is stopped by stopping member 48 protruding upwardly. The registration devices 20 are controlled by a solenoid (not shown), and when moved into the position seen in FIG. 4, the springs 46 move upward against the collation of sheets 16 and the lower reaches of the belts 132. In the case of a thin collation of sheets 16, the subtle spring force applied by the spring 46 insures engaging contact with the belts 132 so that the collation 16 is urged beyond the registration devices 20.

It should be understood by those skilled in the art that various modifications may be made in the present invention without departing from the spirit and scope thereof, as described in the specification and defined in the appended claims.

What is claimed is:

1. Apparatus for conveying one or more sheets of paper along a path, comprising:

a supporting housing;

a first, upstream pulley and a second, downstream pulley mounted on first and second fixed shafts, said first and second fixed shafts being suitably journaled to said housing;

a lower, endless, elastic belt mounted on said first and second pulleys, said belt having an upper and a lower reach, said reaches being substantially horizontal;

a third, downstream pulley mounted on a third fixed shaft suitably journaled to said housing above said lower belt;

a fourth, upstream pulley rotatably mounted on a fourth shaft, each end of said fourth shaft being mounted in a bearing holder mounted on said housing above said lower belt, said fourth pulley biased toward said lower belt; and an upper, endless, elastic belt mounted on said third and fourth pulleys, wherein said fourth pulley pivots upwards about said third shaft when the thickness of the sheets being conveyed requires a larger gap to engage said upper belt.

2. The apparatus of claim 1, additionally comprising a registration device downstream of said fourth pulley, said registration having a stop member and a spring member, said registration device being movable between a stop position in which said stop member is moved into said paper path and said spring member is moved out of said paper path and conveying position in which said spring member is moved upward toward the lower reach of the upper belt and the stop member is moved out of the paper path.

3. The apparatus of claim 2, additionally comprising a solenoid for moving said registration device between said stop position and said conveying position.

4. The apparatus of claim 1 wherein said bearing holder includes means to limit the pivoting of said fourth pulley.

5. The apparatus of claim 4 wherein said limit means includes a screw, said screw being set higher for accommodating thicker sets of sheets.

* * * * *